United States Patent [19]

Klepfer

[11] 4,288,877

[45] Sep. 15, 1981

[54] DISPOSABLE PROTECTIVE GARMENT

[76] Inventor: Harlan A. Klepfer, 16 Meadowstream Ct., Snyder, N.Y. 14226

[21] Appl. No.: 103,486

[22] Filed: Dec. 14, 1979

[51] Int. Cl.[3] ..... A41B 27/12

[52] U.S. Cl. ..... 2/48

[58] Field of Search ..... 2/48–51, 2/52; 24/7

[56] References Cited

U.S. PATENT DOCUMENTS

| | | | |
|---|---|---|---|
| 2,009,831 | 7/1935 | Yerzley | 2/49 R |
| 2,030,135 | 2/1936 | Carpenter . | |
| 2,109,583 | 3/1938 | Bonnett . | |
| 2,142,194 | 1/1939 | Karriol . | |
| 2,523,565 | 9/1950 | Garower | 2/49 R |
| 2,755,576 | 7/1956 | Golden . | |
| 2,902,734 | 9/1959 | Walters | 2/52 |
| 3,443,288 | 5/1969 | Batcheldee et al. . | |
| 3,654,059 | 4/1972 | Zisblah . | |
| 3,875,621 | 6/1975 | Karami | 24/67 |
| 3,884,443 | 5/1975 | McMaster | 248/467 |
| 3,948,258 | 6/1976 | Karami | 128/287 |
| 4,099,784 | 3/1977 | Elias et al. | 211/46 |

FOREIGN PATENT DOCUMENTS

| | | | |
|---|---|---|---|
| 1148145 | 4/1969 | United Kingdom | 2/49 R |
| 1175457 | 12/1969 | United Kingdom | 2/49 R |

*Primary Examiner*—Doris L. Troutman

*Attorney, Agent, or Firm*—Christel, Bean & Linihan

[57] ABSTRACT

A disposable bib, napkin or mini-apron of generally quadrilateral shape having a neck cutout in its upper edge portion and two shoulder pieces adjacent the cutout. The entire upper edge portion is coated with a pressure sensitive adhesive adapted to adhere to fabric pressed there against, the adhesive extending from slightly below the upper edge for an appreciable width downwardly to below the cutout and being protected by a removable overlay extending above the adhesive. For general use, the overlay is folded down to expose the adhesive for attaching the bib to the upper portion of a wearer's clothing. After use, the napkin is easily removed and discarded.

7 Claims, 8 Drawing Figures

12
11
13
14
14
1
4
8
11
15
12'
4
4
12'
1
4
6

15
11
4
4

1
4
8

DISPOSABLE PROTECTIVE GARMENT

BACKGROUND OF THE INVENTION

This invention related to a disposable bib, napkin or mini-apron adapted to be fastened generally to the upper portion of a wearer's clothing to protect the same.

To the hospitalized and the aged, where self feeding is important, protecting clothing during meal times is a real problem. Protective bibs or napkins having adhesive attachment means are old and are described, for example, in U.S. Pat. Nos. 2,009,831, 2,402,734, 2,617,104, 2,902,734, 3,332,547, 3,416,157 3,675,274, 3,871,027, 3,995,321 and 3,979,776. However, in some prior art constructions, the adhesive portions are present in relatively small areas, which can tear away from gauze-like paper, and can leave gaps with resulting loss of protection against soiling. Others have portions which extend behind the wearer or over his shoulder. To fasten such bibs or napkins is frequently beyond the capabilities of persons having limited motor ability in their arms, wrists, or fingers, as for example, victims of rheumatoid or osteoarthritis, the blind or many nursing home residents. The present invention is self attachable by many persons as above described who would have difficulty or find use impossible with prior art articles. Only limited motion is required for attachment with the article described herein.

The present invention has great utility in nursing and retirement homes, where many of the elderly residents suffer from arthritic conditions and other afflications resulting in impaired motor abilities. For them to be able to attach a bib to their clothing by themselves, without the aid of an attendant, would lessen the work load on the staff as well as protect clothing which would cut down laundry time and expense.

In addition to helping morale by being more self sufficient research in the matter has shown a reluctance for the aged to have anything fastened around their necks while eating. They prefer a situation where they can function independently and are not reduced to "children" with around the neck "child bibs".

SUMMARY

It is the general object of this invention to provide a disposable bib, napkin or mini-apron which is free from snaps, ties or strings, which is easily attached to a wearer's clothing by one's self and does not require extensive stretching or movement of arms, wrists or fingers or require eye sight for doing so.

Another object is to accomplish this in a construction which can be mass produced at low cost, and in which the various parts are disposable as a unit after use.

The novel bib of the present invention comprises a generally quadrilateral piece of flexible material, such as paper, fabric or plastic, having a shallow neck cutout at its upper edge. A coating or strip of pressure sensitive adhesive is located at the upper edge portion and extends thereacross. To protect the adhesive until use a removable overlay is provided. For use, the overlay is folded away, exposing the adhesive layer which is placed generally against the upper portion of the wearer's clothing or body with the neck cutout portion adjacent the wearers neck for greatest clothing protection, the overlay being retained on the bib for subsequent disposal therewith.

Further objects of the invention will be apparent from the following description, in conjunction with the accompanying drawings wherein like reference numerals denote like parts throughout the various views.

THE DRAWINGS

DESCRIPTION OF THE ILLUSTRATED EMBODIMENT

Figure 1:
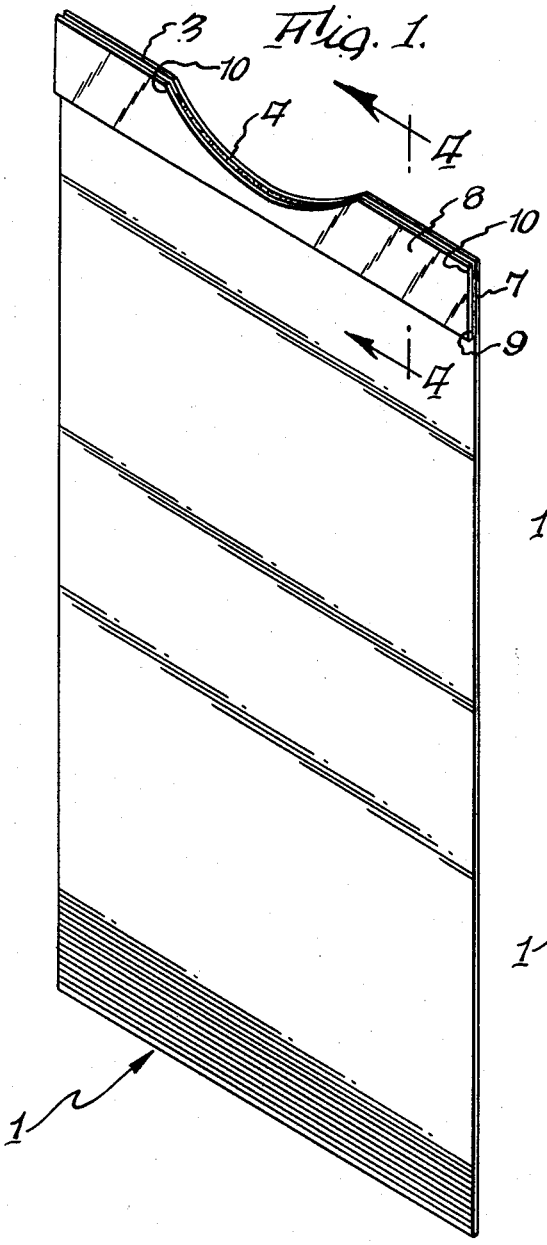
FIG. 1 is a perspective view of a bib or napkin of this invention, taken from the back or body side and showing the adhesive protective overlay as it appears prior to use.
Figure 2:
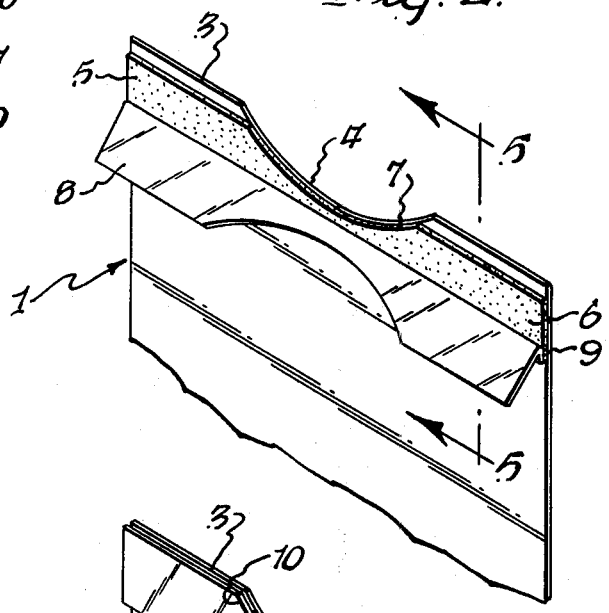
FIG. 2 is a fragmentary view thereof, with the protective overlay folded down in preparation for use.

There is shown a protective garment of this invention, generally designated 1, having a quadrilateral shape, generally rectangular although trapezoid or other appropriate shapes may be employed. The garment is made of paper stock, such as used in conventional paper napkins, for low cost and ease of disposability, although cloth, plastic or other materials can be used when that would be advantageous. The size of the garment will vary, depending upon whether it is intended for use by children or by adults, and also upon whether it is intended for use as a napkin, a bib or an apron-mini or full size. In any case, the garment will be sized to cover the area to be protected. In one embodiment, the bib is rectangular and has a length of approximately 26 inches and a width of 13 inches. In another, the garment is 19½ inches in length and has a width of 13 inches. Both of these fold to a 6½ inch by 6½ inch shape for packaging.

At its upper edge 3, the bib has a centrally located, shallow, neck cutout portion 4. On the opposite sides of neck cutout portion 4 are side portions 5, 6 that generally would be attached to the chest or front shoulder portions of the wearer. A pressure sensitive adhesive layer 7 is disposed across the entire width of the upper back portion of the garment, and is covered with a protective overlay 8 until use. The area of adhesive is sufficient to provide an adequate surface for adhesion to a wearer's clothing or self, so that it will not tear loose from the bib or napkin, and the bib or napkin will not be dislodged or tear loose from the wearer because of slight pulls or tugs of body movement. Beyond this criterion, the width of the adhesive layer may be selected as most convenient. Extending the adhesive layer completely across shoulder portions 5, 6 adjacent upper edge 3, and below neck cutout 4 so as to extend along the edge thereof and for a distance therebelow, provides an adhesive layer across the upper portion of the garment sufficient to provide good adhesion, without tearing, and avoids gaps which would permit soiling of clothing intended to be protected. In general, a continuous film or strip having a width of one and a half or two inches below the top edge is found in tests to be satisfactory, although a greater or lesser width may be employed if desired, and the adhesive might assume other forms, as long as adequate adhesion is obtained without gapping or tearing.

Figure 3:
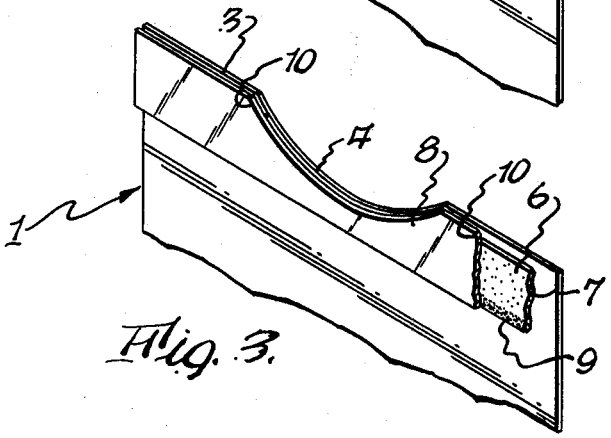
FIG. 3 is a fragmentary view thereof, the protective overlay being shown in place for handling and packaging prior to use, portions being broken away for greater clarity.
Figure 4:
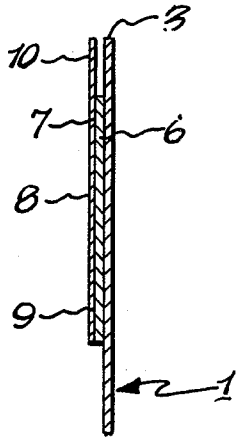
FIG. 4 is a fragmentary sectional view taken about on line 4—4 of FIG. 1.

Overlay 8 is a strip of plastic film which protects the adhesive from unwanted contact with other materials when the bib, napkin or mini-apron is stored or packaged prior to use. Overlay 8 extends the full length of adhesive 7, and the full width thereof from its bottom edge to the upper edge 3 and the edge of cutout 4, as shown in FIGS. 1, 3 and 4. The height of overlay 8 is generally made greater than the height of adhesive layer 7 to provide a clear portion 10 (FIGS. 1 and 4) for easy grasping of the overlay to fold it down and expose the adhesive for use. This can be accomplished by spacing the upper edge of the adhesive below the upper edge 3 of portions 5, 6, for example 1/16 to ⅛th inch, with the upper edge of overlay 8 extending to upper edge 3. As is readily apparent, indiscriminate discarding of the overlays 8 in a large institutional dining room could cause a trash problem. To avoid this, overlay 8 is solidly attached or hinged to adhesive layer 7 along the bottom of the adhesive strip, as shown at 9. This can be accomplished by using more or a stronger adhesive in this area, by treating overlay 8 above hinge 9, for example with a silicone release agent, so as to have less affinity for adhesive 7 than the untreated overlay area 9, or by any suitable means offering greater resistance to separation of overlay 8 from adhesive 7 at the lower portion 9 than from the adhesive above. Hinge portion 9 provides for retention of overlay 8 on the bib after the adhesive 7 is exposed, and thus prevents clutter. Where that is not a problem, hinge 9 may be omitted.

Figure 5:
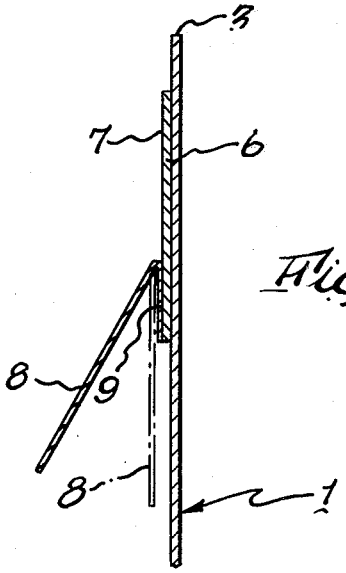
FIG. 5 is a fragmentary sectional view taken about on line 5—5 of FIG. 2, the fully folded position of the protective overlay being indicated in phantom.

Prior to use, overlay 8 completely covers and protects adhesive 7. In preparation for use, either clear area 10 is grasped and overlay 8 pulled away, being peeled from adhesive layer 7 to the position of FIG. 5, exposing the adhesive area on the back of the protective garment while retaining overlay 8 attached to the garment at 9. Thereafter, the user places the neck cutout 4 below his chin for central positioning on his chest and shoulder portions 5 and 6 will be in position for pressing against the user's garments. The bib then adheres to the wearer's person or clothing by virtue of the pressure sensitive adhesive which seals the area completely across the top of the bib. Since there is no portion of the bib behind the neck or shoulders the arms and hands need not be stretched and no finger dexterity is required. In use the napkin, because of its additional length and the ability to fasten it high on the wearers body, gives napkin protection to a large area of the wearers clothing from below the chin down covering the lap area. Also, without being detached from the body, the lower end can be picked up to wipe the mouth if desired and whether this novel napkin is attached high or low on the wearer's body it will not slide off leaving wearers clothing unprotected. After use, the bib is easily pulled off and discarded, with the overlay, leaving no visible marks from the adhesive on the wearer's garments.

Figures 6, 7, 8:
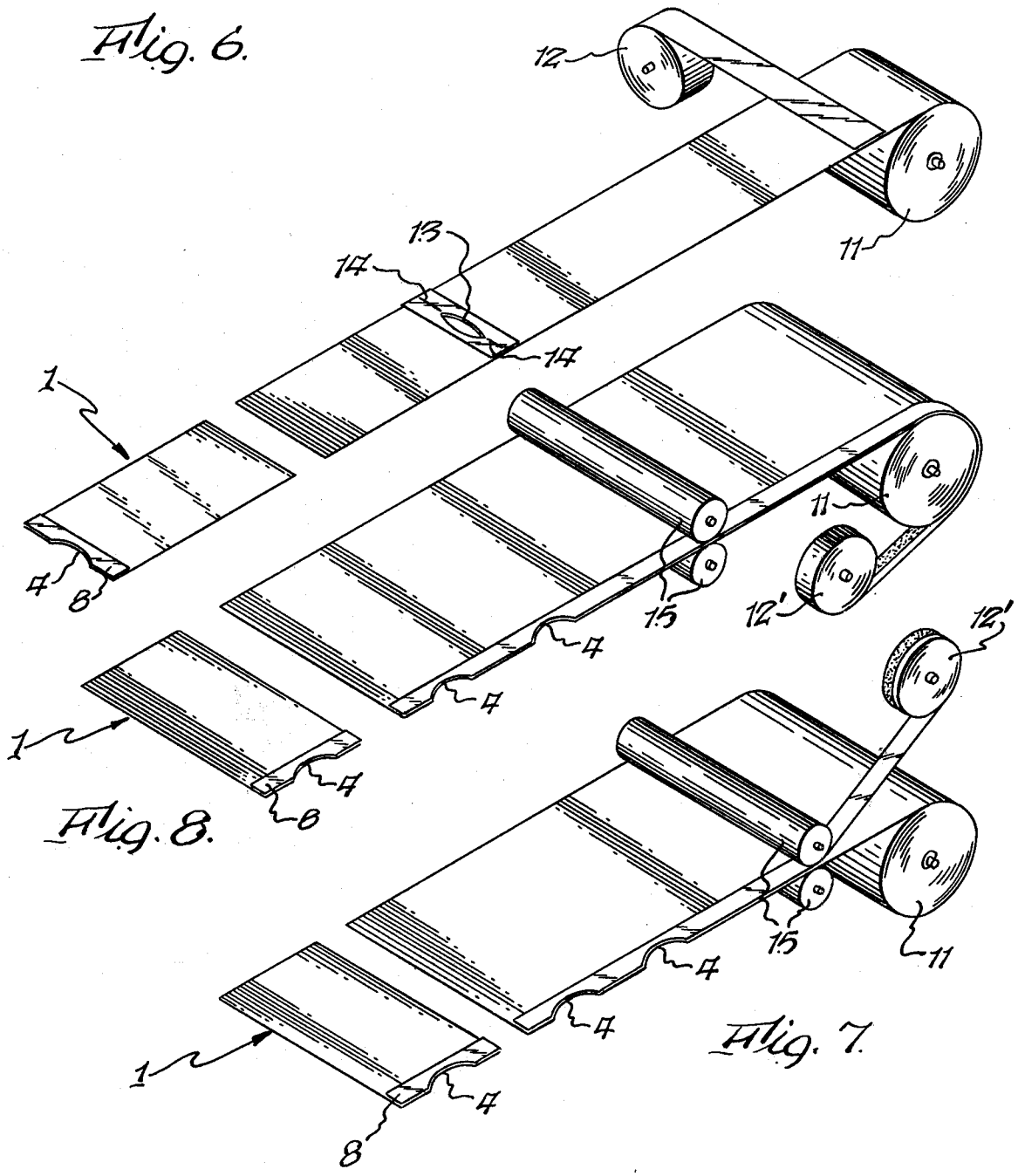
FIGS. 6, 7 and 8 are generally schematic, perspective views illustrating possible production methods and apparatus.

The bibs of this invention can be mass produced by passing sheet material for the garment body from a roll 11 under a work station (FIG. 6). The adhesive layer 7 and overlay 8 are applied together from a roll 12 transversely across the sheet at suitable spacings. Thereafter at other stations the sheet material and adhesive layer are cut, stamped and scored as shown at 13 and 14 to produce the bibs which can be torn off along score lines 14. Another method of production would be rolling the adhesive strip 7 and overlay 8 on the sheet material from a roll 12 thereof lengthwise thereof, between pinch rolls 15, then cutting or stamping the stock to form cutouts 4, and scoring the stock in the desired shapes for packaging, as shown in FIG. 7. The adhesive-overlay strip also can be applied from below, as shown in FIG. 8.

The adhesive layer 7 can be of various known pressure sensitive compositions, and be applied in strip, film or other forms. Overlay 8 can be of paper, plastic or any suitable material. These elements of my invention being well known, per se, no further description thereof is necessary.

What is claimed is:

1. A protective garment in the form of a bib, napkin or apron comprising a body of flexible sheet material having an upper edge, a pressure-sensitive adhesive extending substantially continuously transversely across said garment at its upper portion, said adhesive having a width extending downwardly from said upper edge for an appreciable distance, an overlay covering said pressure-sensitive adhesive and adapted to protect said adhesive from unwanted contact, and means for facilitating the removal of said overlay, wherein said upper edge has a relatively shallow neck cutout portion at its central portion and shoulder pieces at either side of said neck cutout portion and wherein the width of said adhesive extends from slightly below said upper edge of said shoulder pieces to below said cutout portion, wherein said overlay extends beyond said adhesive at said upper edge to facilitate removal of said overlay from said adhesive, and wherein the bottom edge portion of said overlay remains adhered to the bottom edge portion of said adhesive under normal conditions of use after removing said overlay from the remainder of said adhesive.

2. A protective garment in the form of a bib, napkin or apron comprising a body of flexible sheet material having an upper edge, a pressure-sensitive adhesive extending substantially continuously transversely across said garment at its upper portion, said adhesive having a width extending downwardly from said upper edge for an appreciable distance, an overlay covering said pressure-sensitive adhesive and adapted to protect said adhesive from unwanted contact, and means for facilitating the removal of said overlay, wherein said upper edge has a relatively shallow neck cutout portion at its central portion and shoulder pieces at either side of said neck cutout portion and wherein the width of said adhesive extends from slightly below said upper edge of said shoulder pieces to below said cutout portion, wherein said overlay extends beyond said adhesive at said upper edge to facilitate removal of said overlay from said adhesive, and wherein said overlay remains attached to said garment under normal conditions of use for subsequent disposal therewith after exposing said adhesive for use.

3. The garment of claim 2 wherein said flexible sheet is paper.

4. The garment of claim 2 wherein said flexible sheet is a textile material.

5. The garment of claim 2 wherein said flexible sheet is a plastic.

6. The garment of claim 2 wherein said overlay is a strip of paper.

7. The garment of claim 2 wherein said overlay is a strip of plastic film.

* * * * *